US009308537B2

(12) United States Patent
Krichtafovitch

(10) Patent No.: US 9,308,537 B2
(45) Date of Patent: Apr. 12, 2016

(54) ELECTROSTATIC AIR CONDITIONER

(71) Applicant: Igor Krichtafovitch, Kirkland, WA (US)

(72) Inventor: Igor Krichtafovitch, Kirkland, WA (US)

( * ) Notice: Subject to any disclaimer, the term of this patent is extended or adjusted under 35 U.S.C. 154(b) by 166 days.

(21) Appl. No.: 14/007,916

(22) PCT Filed: Jul. 22, 2013

(86) PCT No.: PCT/US2013/051440
§ 371 (c)(1),
(2) Date: Sep. 26, 2013

(87) PCT Pub. No.: WO2014/105217
PCT Pub. Date: Jul. 3, 2014

(65) Prior Publication Data

US 2014/0174294 A1 Jun. 26, 2014

Related U.S. Application Data

(60) Provisional application No. 61/848,086, filed on Dec. 26, 2012.

(51) Int. Cl.

| | |
|---|---|
| ***B03C 3/12*** | (2006.01) |
| ***B03C 3/41*** | (2006.01) |
| ***B03C 3/47*** | (2006.01) |
| ***B03C 3/09*** | (2006.01) |
| ***B03C 3/38*** | (2006.01) |
| ***B03C 3/72*** | (2006.01) |

(52) U.S. Cl.
CPC ... *B03C 3/12* (2013.01); *B03C 3/09* (2013.01); *B03C 3/38* (2013.01); *B03C 3/41* (2013.01); *B03C 3/47* (2013.01); *B03C 3/72* (2013.01); *B03C 2201/04* (2013.01); *B03C 2201/28* (2013.01)

(58) Field of Classification Search
CPC .. B03C 2201/04; B03C 2201/28; B03C 3/09; B03C 3/12; B03C 3/38; B03C 3/41; B03C 3/47; B03C 3/72
See application file for complete search history.

(56) References Cited

U.S. PATENT DOCUMENTS

| | | | |
|---|---|---|---|
| 2,526,402 | A | 10/1950 | Palmer |
| 3,691,373 | A | 9/1972 | Compton et al. |
| 3,717,148 | A | 2/1973 | Svab |

(Continued)

OTHER PUBLICATIONS

Krichtafovitch, "International Search Report and Written Opinion" Patent Cooperation Treaty. Issued for International Application No. PCT/US2013/051440 on Dec. 23, 2013. (16 Pages).

(Continued)

*Primary Examiner* — Christopher P Jones
(74) *Attorney, Agent, or Firm* — Sutherland Asbill & Brennan LLP

(57) ABSTRACT

An electrostatic air conditioner having at least one ion emitting member (i.e., corona frame) and at least one ion collecting member (i.e., collecting cartridge) is provided. The corona frame and collecting cartridge are configured to have active and passive areas and be removable from the housing within which they are positioned. The passive areas provide additional spacing between the active area and the side walls of the housing, and provide several advantages over existing electrostatic air conditioners, e.g., eliminates barriers between active corona wires and the housing walls, which prevents any settling of chemically active or electrically active matter (vapor or particles) on such barriers and/or housing walls (due to air flow).

33 Claims, 19 Drawing Sheets

(56) References Cited

U.S. PATENT DOCUMENTS

| | | | |
|---|---|---|---|
| 4,007,024 | A | 2/1977 | Sallee et al. |
| 5,076,820 | A | 12/1991 | Gurvitz |
| 5,407,639 | A | 4/1995 | Watanabe et al. |
| 6,115,230 | A | 9/2000 | Voigts et al. |
| 6,176,977 | B1 | 1/2001 | Taylor et al. |
| 7,077,890 | B2 | 7/2006 | Botvinnik |
| 7,150,780 | B2 | 12/2006 | Krichtafovitch |
| 7,311,762 | B2 | 12/2007 | Taylor et al. |
| 7,404,935 | B2 | 7/2008 | Lau et al. |
| 7,465,338 | B2 | 12/2008 | Kurasek |
| 7,517,505 | B2 | 4/2009 | Botvinnik et al. |
| 8,049,426 | B2 | 11/2011 | Krichtafovitch et al. |
| 2009/0261268 | A1 * | 10/2009 | Schwiebert ..... B03C 3/41 250/424 |
| 2010/0051709 | A1 | 3/2010 | Krichtafovitch et al. |
| 2010/0052540 | A1 | 3/2010 | Jewell-Larsen et al. |

OTHER PUBLICATIONS

Krichtafovitch et al. "EFA Air Disinfection Using Kronos based Air Purifiers", Proc. ESA Annual Meeting on Electrostatics 2008, pp. 1-11.

* cited by examiner

ELECTROSTATIC AIR CONDITIONER

CROSS REFERENCE TO RELATED APPLICATIONS

This application claims priority from and the benefit of U.S. Provisional Application Ser. No. 61/848,086 filed Dec. 26, 2012.

BACKGROUND

1. Technical Field

The present principles relate to air conditioning devices. More particularly, it relates an electrostatic air conditioner.

2. Discussion of Related Art

Electrostatic air purifiers and conditioners are known and often utilize parts referred to as "corona" wire or "corona electrode", "collecting electrode", and barriers between these electrodes. These parts are contained within a housing, while the corona electrode and the collecting electrode are most often removable from the housing for periodic cleaning. The barriers serve to protect a sparkover or creeping (along the surface) discharge between the electrodes.

In other known devices, an ion collecting member (Collecting cartridge or collecting electrode) and an ion emitting member (Corona electrode or corona frame) are supported on the floor of the housing.

In both of the above designs the electrodes are attached flush to the walls of the housing in order to prevent dirty air from bypassing between the electrodes and the walls.

The disadvantage of such designs is that contaminating matter (vapor or particles), containing chemically aggressive or electrically conductive matter enters into the housing with the air and settle on the barriers, housing's floor and/or on the walls.

Such an aggressive or conductive matter contaminates plastic barriers and walls and makes them electrically conductive. After a while the contamination is difficult or even impossible to remove. Being chemically aggressive this matter penetrates deeply into plastic body and changes non-conductive material's (like ABS) physical properties making it semi-conductive material. The barriers and walls being semi-conductive shorten the distance between the electrodes and provoke the electrical discharge (spark or creeping discharge) between the corona wire and the collecting electrode.

When the device is new (and barriers are non-conductive) the air gap between the corona frame and the collecting cartridge is equal to D. The gap D is selected of such length that no electrical discharge like spark or arcing between the electrodes takes place while the corona discharge occurs and ions are emitted from the corona electrode to the collecting electrode. When the barriers between these electrodes become semi-conductive the ions emitted from the corona wire travel to the barrier's top. This ions' flow constitutes an ionic current flowing from the corona electrode to the barrier. The barrier then assumes the electrical potential that is close to the electrical potential of the corona wire effectively shortening the gap D. The same event happens when particles settle on the walls.

In this event an electrical discharge may occur from the barriers' edges (or from the contaminated walls) to the collecting cartridge. This unfortunate event shortens the lifetime of electrostatic air conditioning systems when they are employed in certain geographical, industrial or climatic regions with chemically aggressive or electrically conductive contaminations present in the air.

In the prior art, the corona frame is made of electrically insulating material (plastic). On this frame thin corona wires are located. The wires are parallel to each other. At the bottom and at the top of the corona frame the conductive wires meet and touch an electrically insulating material of the frame. The electric field strength at the spot where two materials touch each other is substantially higher than in the middle part of the wires. To alleviate the electric field raise additional insulating barriers are installed on the frame. These barriers are located at the side of the corona frame that is closest to the opposite electrodes.

The disadvantage of such design is the same as above, i.e., the dust, containing chemically aggressive or electrically conductive matter (vapor or particles), enters into the air conditioner and settles on the corona frame barriers.

When the barrier becomes semi-conductive, the ions emitted from the corona wire go to the corona frame barriers' edges. The barrier then assumes the electrical potential that is close to the electrical potential of the corona wire, effectively shortening the gap between the corona electrodes and the collector electrodes.

Therefore some "hissing" and even sparking may occur from the barrier edges (or from the contaminated walls) to the corona or collecting electrodes. Again, this unfortunate event shortens the lifetime of electrostatic air conditioning system that works in certain geographical, industrial or climatic regions where chemically aggressive or electrically conductive contaminations are common in the air.

Another drawback to existing corona frame designs is the wire vibration that occurs from time to time and which causes unpleasant noise, as well as may lead to the wire degradation and damage.

Still another previous art disadvantage is that when a corona wire needs a replacement, the whole frame is disposed or new wires are attached to the frame by rather cumbersome and time consuming process. This increases cost and maintenance expenses.

Still another disadvantage of the existing air conditioners is that some undesirable electrical discharge may take place when foreign matter is trapped between the electrodes or the electrodes became dirty.

Therefore there is a need for simple yet reliable mean for undesirable discharges detection.

The electrostatic air conditioning system of the present principles is free of the above-noted deficiencies.

SUMMARY

According to an implementation, the electrostatic air conditioner system includes a housing generally having two vents and four sides. An ion emitting member (corona frame) and an ion collecting member (i.e., collecting electrode, or cartridge) are positioned within the housing such that the ion emitting member and the ion collecting member are located at a first distance D from each other and substantially parallel to each other. A high voltage generator is configured to provide a potential difference at output terminals between the ion emitter member and the ion collecting member.

In the proposed design both ion emitting member and ion collecting member contain active area and non-active (passive) area. The active areas are located at certain distance from the sides of the housing. This prevents undesirable discharge between the electrodes through the walls in the case of plastic being contaminated with conductive and/or chemically aggressive matter.

The electrostatic air conditioner system therefore comprises a housing having inlet and outlet vents and sides, such as walls, floor and a top; an ion emitting member (corona frame) and an ion collecting member (collecting cartridge) positioned in said housing, wherein at least one of the ion emitting member and the ion collecting member comprises an active and a passive area, said active area containing conductive electrodes while said passive area containing non-conductive media; said active area being located at a second distance f (for ion emitting member) and third distance K (for ion collecting member) from the sides of the housing.

At least one of the ion emitting and ion collecting member is removable from the housing for periodic cleaning or wire replacement.

The ion emitting member preferably contains thin wire-like electrically conductive electrodes connected to a first terminal of the high voltage generator. As a general rule, the electrical potential of this ion emitting member is positive with regard to the electrical potential of the ion collecting member.

The ion collecting member contains flat plate-like elongated collecting electrodes connected to a second terminal of the high voltage generator. The second terminal's electrical potential is negative with regard to the ion emitting member electrical potential.

As a rule of a thumb both second distance f and third distance K should be equal to or greater than a half of the first distance D, i.e., $f \geq D/2$ and $K \geq D/2$.

In order to minimize electric field strength at the points where the electrodes meet the plastic frame smooth shape conductive members are implemented. They are located at ends of the ion emitting and/or ion collecting electrodes and electrically connected to electrodes directly or via electrically conductive media.

These conductive members are of elongated shape and are substantially orthogonal to the corresponding electrodes they are electrically connected to. In a preferable implementation, such smooth conductive member is propagated along a perimeter of the active area.

To provide better insulation at least one part of said passive area located on one member (ion emitting or ion collecting) is recessed with regards to the corresponding electrode away from the opposite member (ion collecting or ion emitting member correspondingly).

In order to facilitate corona wires periodic replacement the ion emitting member comprises of permanent and replaceable parts. Such replaceable parts comprises corona wires and supports, where the corona wires are attached to the supports; and the supports are attached to the permanent part of the ion emitting member In order to prevent wire from vibration the ion emitting member includes a supporting member which is located preferably in the middle of the active area and is in mechanical contact with corona wires.

In order to provide good air filtration and at the same time to present low air resistance the collecting electrodes are flat and the repelling electrodes are placed between the collecting electrodes. The repelling electrodes comprising flat parts substantially parallel to air flow and protuberant parts substantially orthogonal to the air flow. These protuberant parts (like bulges) repel charged particulates toward the collecting electrodes to facilitate their collection.

The ion collecting member may also comprise one or more middle support members being configured to support the collecting electrodes and repelling electrodes mid-way between their respective ends.

Both ion emitting and ion collecting middle support members are preferably positioned on opposite from the opposite member (i.e., ion collector or ion emitter correspondingly) side.

As for the ion collecting member the middle support is preferably made of slightly electrically conductive, i.e., anti-static, material in order to provide the inter-electrodes capacitance discharge.

An antenna-like electrical discharge detector is located in the vicinity of the ion-emitting and/or ion collecting members. It may be a rod, or a wire, or a coil, or a metal frame capable to detect slight electrical discharge signal and send an electrical signal to the high voltage generator.

If the high voltage generator receives such a signal it reduces the generated potential difference in order to quench the electrical discharge.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

The present principles are directed to air conditioning devices, and more particularly those air conditioning systems that utilize electrostatic filters.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Figure 1:
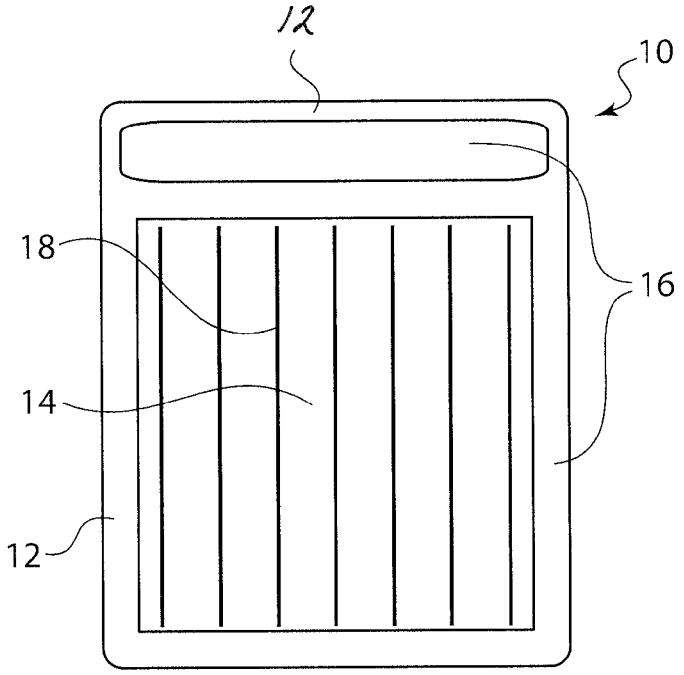
FIG. 1 is front plan view of a corona frame according to an implementation of the present principles.

Referring to FIG. 1, there is shown a corona frame 10 according to one implementation of the invention. The corona frame in an electrostatic air conditioning system is also sometimes referred to as the ion emitting member.

In this implementation, the corona frames 10 which are used in conjunction with collecting cartridges and each have an active area 14 and passive or inactive 16 areas. The corona frame 10 has an outer frame 12, and the active area 14 comprises the space occupied by the electrodes 18 (e.g., thin corona wires). As shown, the corona wires 18 are located in the central area of the frame 12, and thereby make up the active area 14. The periphery of the frame 12, which is the inactive area 16, is occupied by non-conductive passive media (e.g., plastic and/or air). In this implementation a handle 20 can be integrated into the frame 12 to assist in the insertion and/or removal of the corona frame from the housing of the electrostatic air conditioner.

Figure 2:
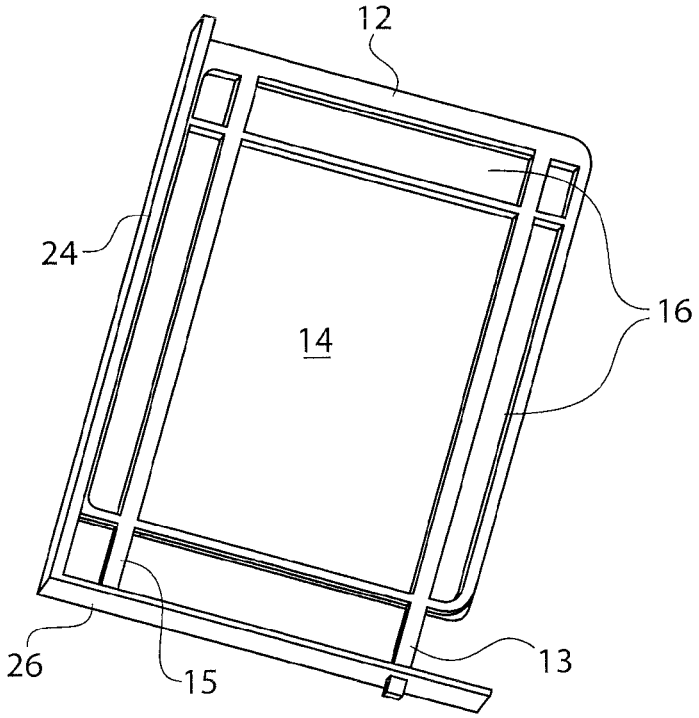
FIG. 2 is a perspective view of the plastic support of the corona frame according to an implementation of the present principles.

FIG. 2 shows a partial schematic view of the left housing wall 24 and housing floor 26 configured to accommodate the corona frame 12. In this partial schematic view, the corona wires 18 have been removed from the active area 14, as well as the right housing wall and top, for clarity purposes. The corona frame 12 is supported by the legs 13 and 15.

Figure 3:
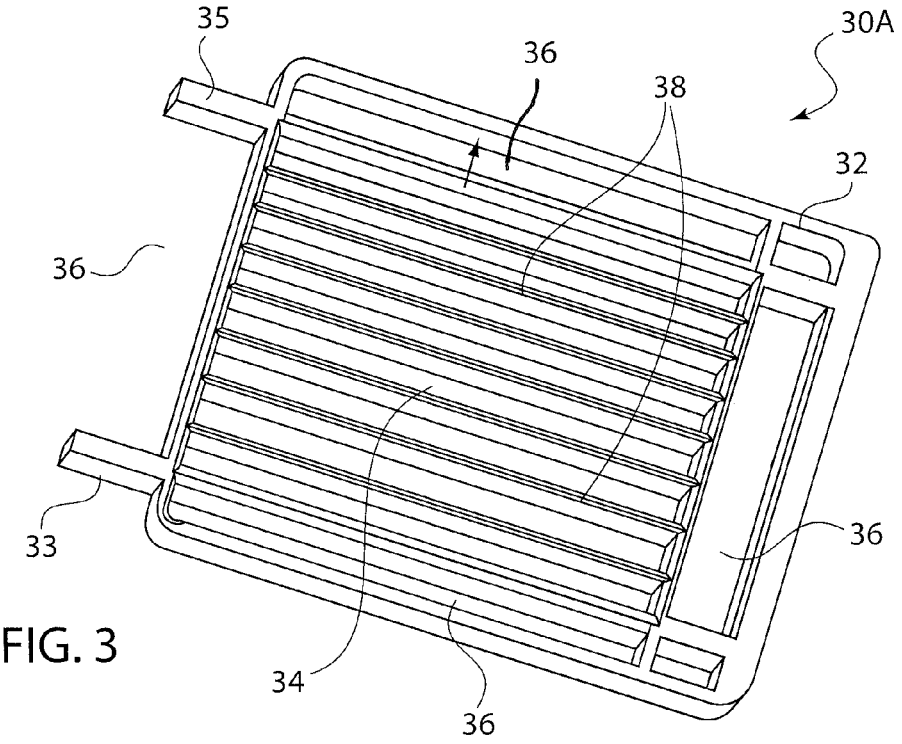
FIG. 3 is a perspective view of the ion collecting member according to a implementation of the present principles.
Figure 4:
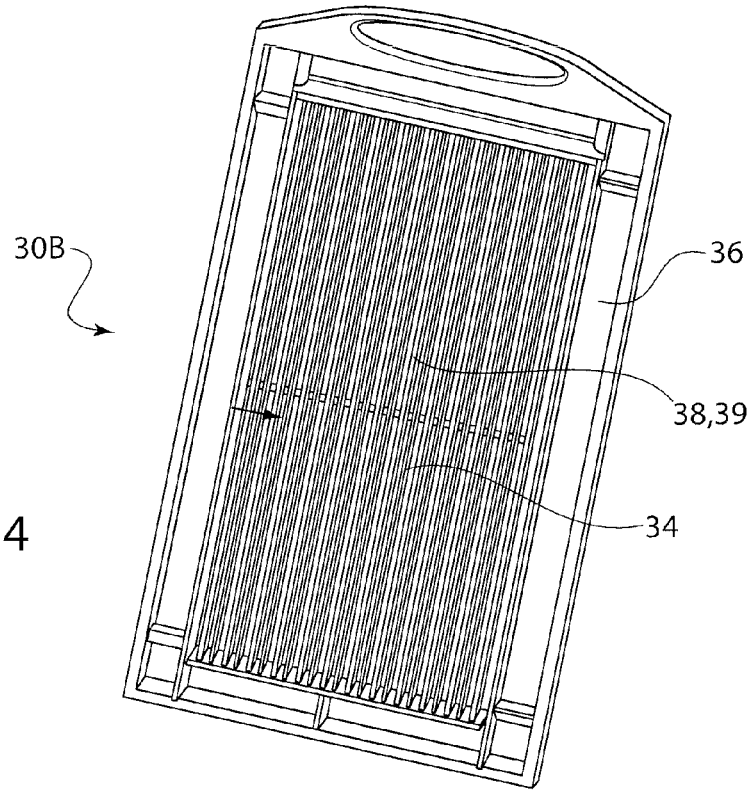
FIG. 4 is a perspective view of another implementation of the ion collecting member according to an implementation of the present principles.

FIGS. 3 and 4 show two implementations of the collecting cartridge 30A and 30B, respectively, according to the present principles. In each implementation, the cartridge has an outer frame 32 that embraces the active and inactive areas. The active area 34 is configured to be in the center where the collecting 38 and repelling 39 electrodes are positioned. The passive or inactive areas 36 are open and allow for the passage of air.

Figure 5:
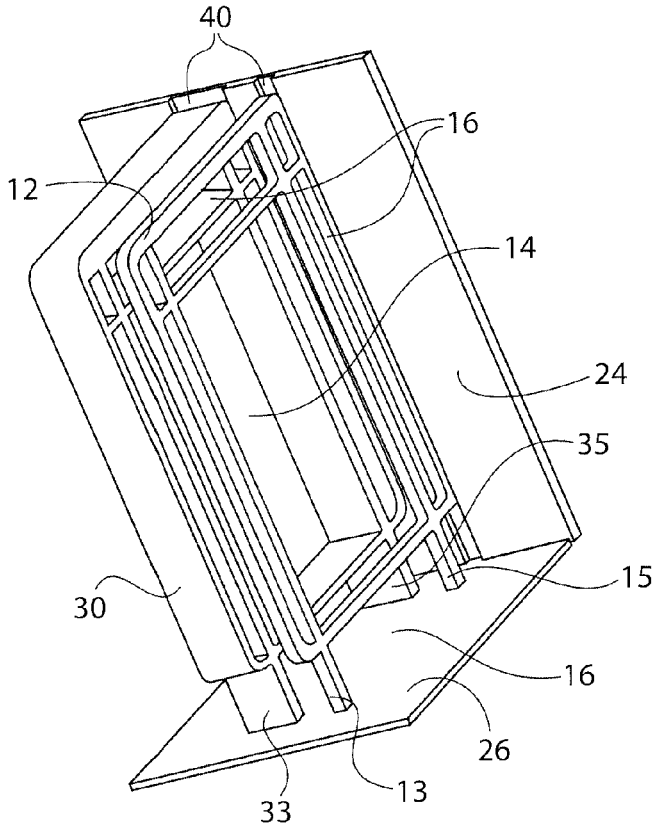
FIG. 5 is a perspective view of a housing having the corona frame and collecting cartridge of the present principles implemented therein.
Figure 6:
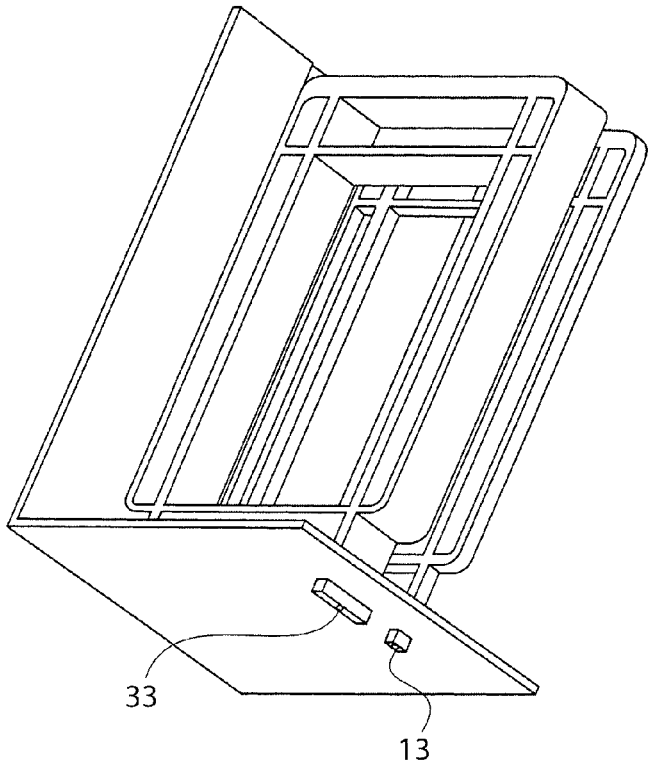
FIG. 6 is bottom perspective view of a housing having the corona frame and collecting cartridge of the present principles implemented therein.

FIGS. 5 and 6 show a partial schematic view of a collecting cartridge 30 and corona frame 12 in a housing according to an implementation of the invention. Those skilled in the art will appreciate that the housing is made of an electrically insulating material (such as ABS plastic), and that the corona frame 12 and collecting cartridge 30 are inserted into the housing by sliding the same along slots 40 in the housing walls 24. Once inserted into the housing, the corona frame 12 and the collecting cartridge 30 are supported by the slots 40, and legs 15 and 35, respectively, which rest on the housing floor 16 and by the top lid (not shown in the FIG. 5). Internal to the legs 15 and 35, are located high voltage (HV) contacts 13 and 33, respectively, which pass through the housing floor 24 to a bottom compartment where the high voltage generator is situated.

When both the corona frame and the collecting cartridge's active areas are kept away from the walls as shown in the above configurations, and there are not any barriers between them, three positive things occur:

First, the chemically active or electrically conductive matter (vapor or particles), that enters into the air cleaner does not settle on the barriers because in the present implementations, there are no barriers;

Second, most of the chemically active or electrically conductive matters do not settle on the housing walls because moving air (through the inactive areas) blows such material/matter away from the walls. Most of the air is drawn through the active area; and Third, chemically active or electrically conductive matter that is passing near or along the housing walls is not electrically charged (i.e., it did not pass through the corona frame active area) and, therefore, does not settle on the walls and, as a result, cannot make walls electrically conductive.

Those skilled in the art will appreciate that "creeping" path from the corona electrodes/wires to the collecting electrodes will now be of a considerably longer distance: that is, from the corona wire to the "leg", then along the wall or the floor, then along another "leg" to the collecting electrode.

As a general design rule of the thumb, the creeping path between the electrodes should be at least twice as long as the air gap between those electrodes. Therefore, the passive/inactive area width (i.e., the distance from the active area to the nearest wall) should be no less than half of the air gap between the corona frame and the collector cartridge.

Figure 7:
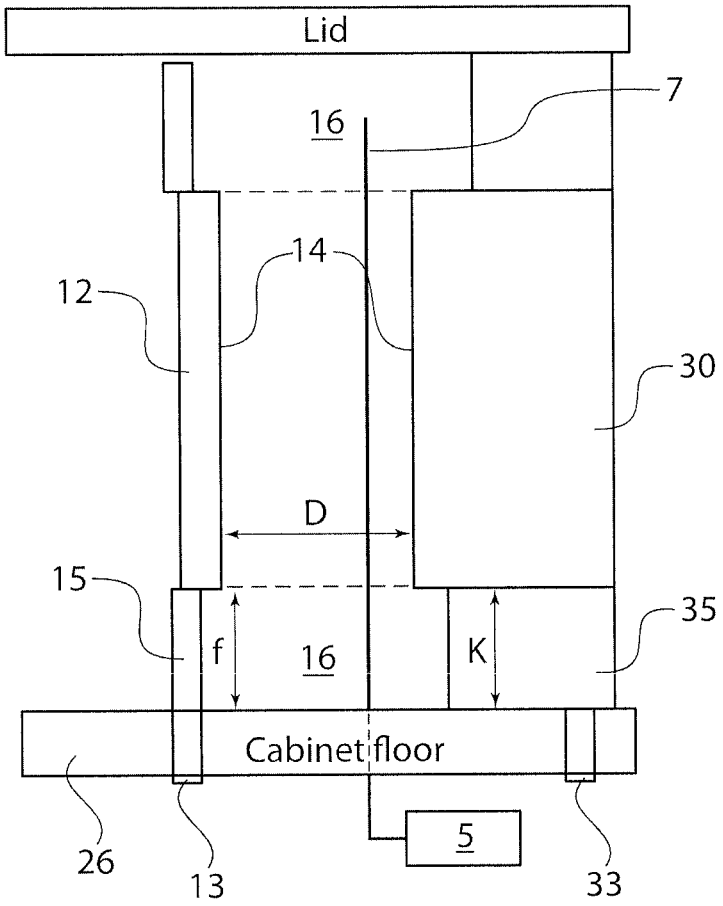
FIG. 7 is side plan view of the corona frame and collecting cartridge positioned within the housing according to an implementation of the present principles, the antenna for the discharges detection is also schematically shown.

Even better results may be achieved if the passive/inactive area is slightly recessed away from the opposite electrode. FIG. 7 shows, in a schematic manner, the preferred placement of the "legs" 15 and 35 for both the corona frame and the collecting cartridge, respectively. In the FIG. 7 all legs' length are equal to f for the corona frame or to K for the collecting cartridge, i.e., passive/inactive area distance to the walls is greater than half of the air gap length: $f \geq D/2$ or $K \geq D/2$. In this configuration, the legs 15 of the corona frame 12 are such that the corona frame is slightly offset from the legs as seen in this side view of FIG. 7. As will also be noted, the legs 35 of the collecting cartridge 30 are also recessed or offset from the electrodes of the collecting cartridge.

When some of the electrodes are contaminated, broken, or loose, undesirable electrical discharge may occur. In such event, the high voltage generator should detect the electrical discharge (like spark or hissing) and shut the voltage OFF.

The proposed means for the electrical discharge detection is an antenna 7 as shown in the FIG. 7. Such antenna 7 may be configured as piece of wire or as a conductive loop located near the ion emitting or ion collecting members and preferably in the middle of them in the passive area. It may be hidden in the housing wall as well. The antenna 7 supplies high voltage generator 5 with electrical signal when the undesirable electrical discharge occurs. The antenna-like electrical discharge detector 7 is located in the vicinity of the ion-emitting (12) and/or ion collecting (30) members. The detector 7 may be, for example, a rod, a wire, a coil, or a metal frame capable of detecting a slight electrical discharge signal and sending an electrical signal back to the high voltage generator 7, which would operate to turn off the HV generator 5.

Figure 8A:
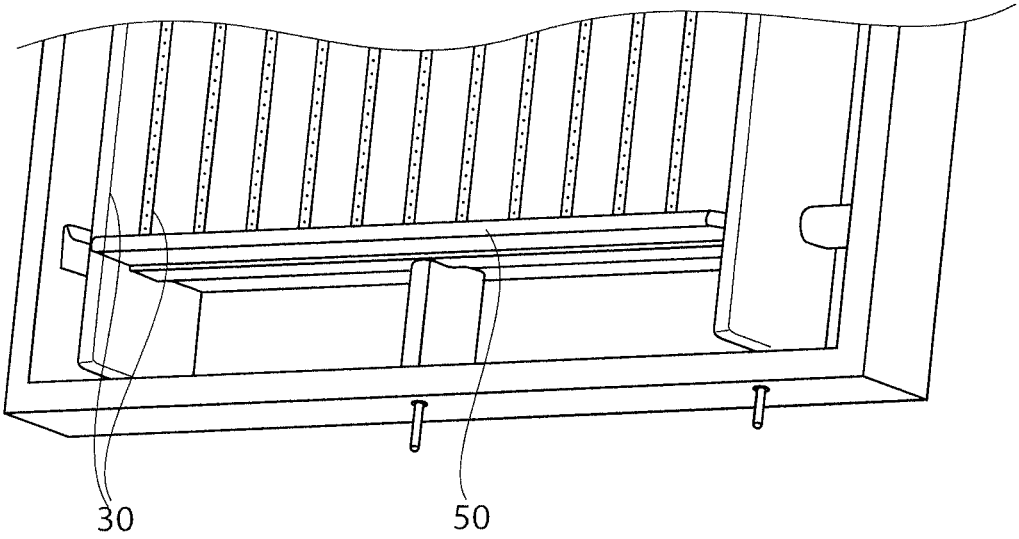
FIG. 8A is a partial perspective view of the collecting cartridge according to an implementation of the present principles.
Figure 8B:
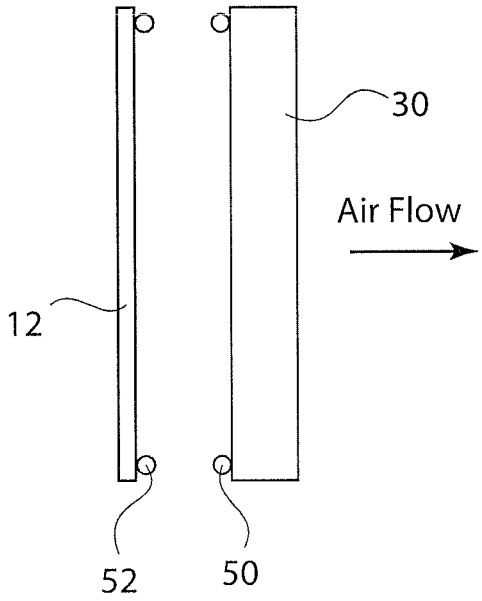
FIG. 8B is a side view of the corona frame and collecting cartridge within the housing showing the conductive bars according to an implementation of the present principles.

Referring to FIGS. 8A and 8B, in order to "smooth" the electrical field near the ends of the active areas 14 (i.e., where the electrodes connect to the non-conductive support), electrically conductive bars 50 and 52 are placed in electrical contact with the collecting electrodes 30 and corona wires 12, respectively. These bars 50, 52 have a smooth shape and are electrically connected (directly or via resistive media) to their respective corresponding electrodes 30, 12.

Bars 50 and 52 serve two functions: first, they smooth the electric field near the electrodes' ends; and second, in a case that the conductive contaminants settle on the bars, no electrical discharge may take place between those bars and their corresponding electrodes since they are electrically connected to each other.

FIGS. 9-17 will now describe the corona frame design according to a preferred implementation of the present principles.

Figure 9A:
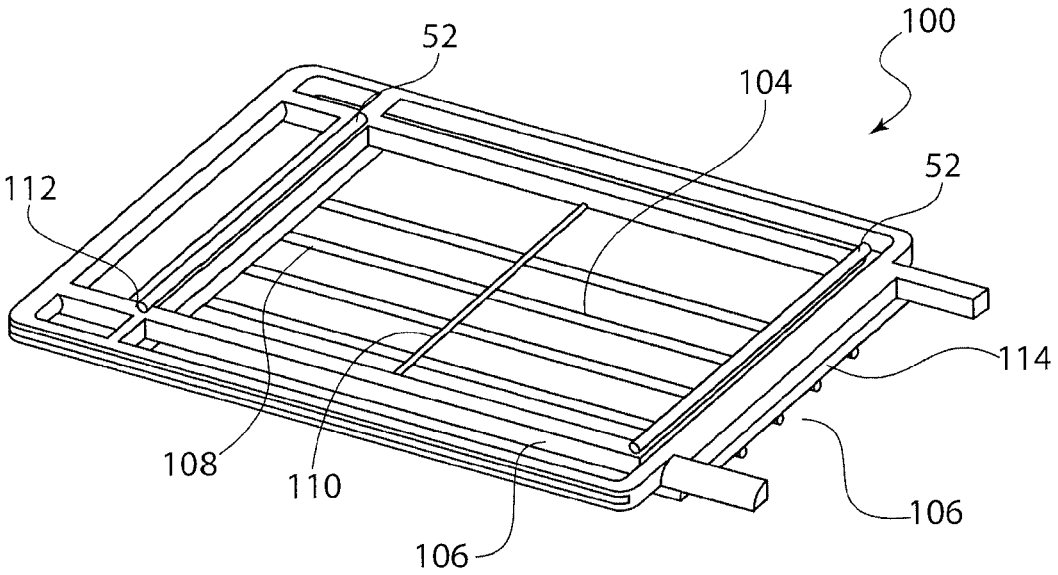
FIGS. 9A and 9B are perspective view of the corona frame according to a preferred implementation of the present principles.
Figure 9B:
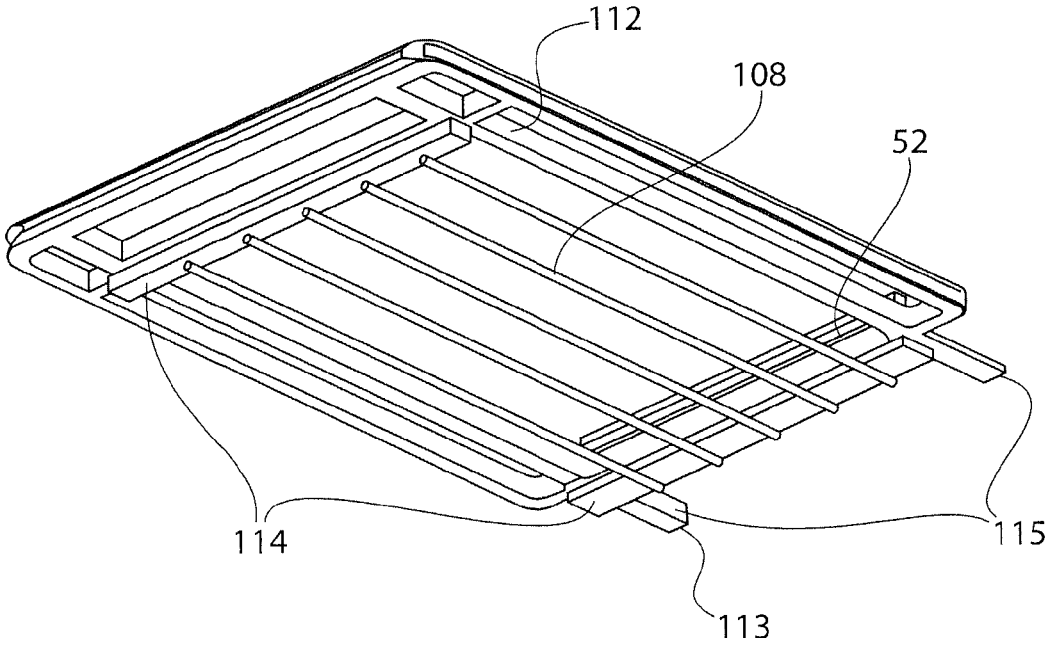

FIGS. 9A and 9B show the corona frame 100 according to a preferred implementation of the present principles. As noted above, this implementation has several advantages over the prior known devices.

In this implementation, the insulating barriers are removed from the corona frame, and the conductive bars 52 are installed on or near the ends of the corona frame and are electrically connected (directly or via resistor) to the corona wires 108. Since these bars are smooth, they decrease the electric field strength near the wires' ends playing essentially same role as plastic barriers in previous art. Having essentially the same electrical potential as the corona wires 108, these bars 52 can not cause any electrical discharge between the wires 108 and the bars 52. The conductive bars 52 are preferably located at the side of the corona frame closest to the collecting cartridge but may be located at the opposite side of the corona wires as well, i.e., behind the wires if one looks from the collecting cartridge side.

Another advantage of this new design is that the passive (or inactive) areas 106 are added to all four sides of the active area 104 (i.e., the area occupied by the corona wires 108). Finally, according to one preferred implementation, the corona frame 100 is made up of permanent 112 and replaceable 114 parts. The plastic frame 112 with conductive bars 52 and the middle support 110 make up the permanent parts, while the outermost supports 114 with the corona wires 108 attached to them, make up the replaceable parts. The middle support 110 functions to mitigate and/or prevent vibration of the corona wires 108.

As can be seen in FIG. 9*b*, the HV contacts or connectors 113 are attached to the leg 115 that is located in the passive area 106. The HV contacts connect the corona wires 108 and conductive bars 52 to the high voltage generator (not shown).

Figure 10:
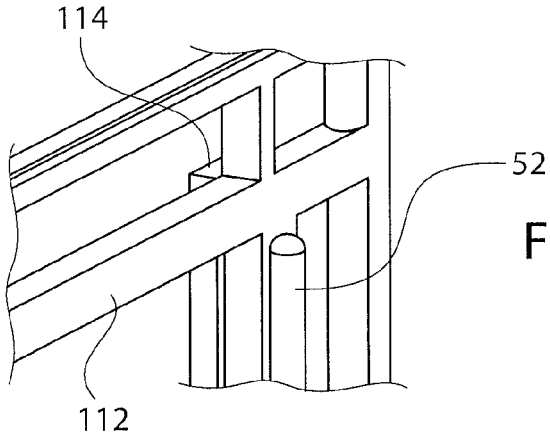
FIG. 10 is a partial close up view of the corona frame showing the positioning of the replaceable support and conductive bar according to an implementation of the present principles.

Referring to FIG. 10, the conductive bars 52 preferably have smooth contours all around to prevent any electric field increase near their edges or ends.

Figure 11:
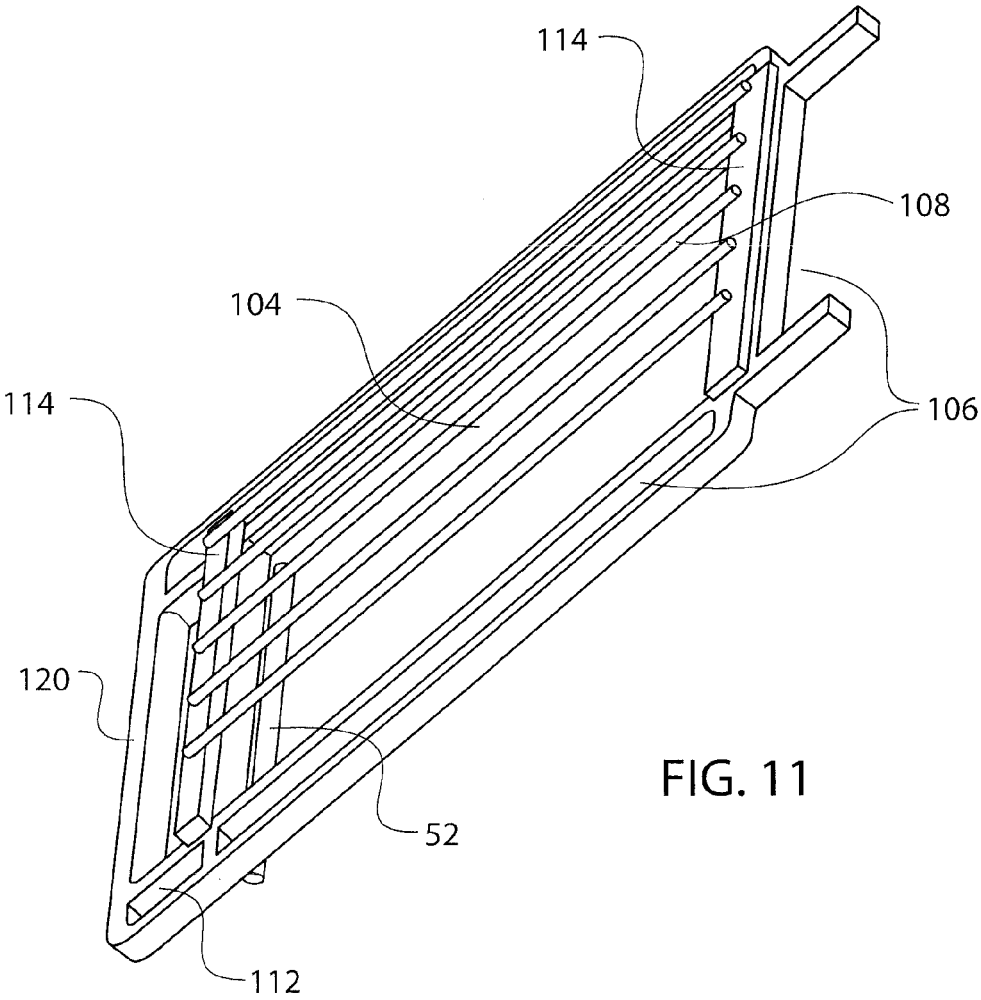
FIG. 11 is another perspective view of the corona frame according to an implementation of the present principles.
Figure 12A:
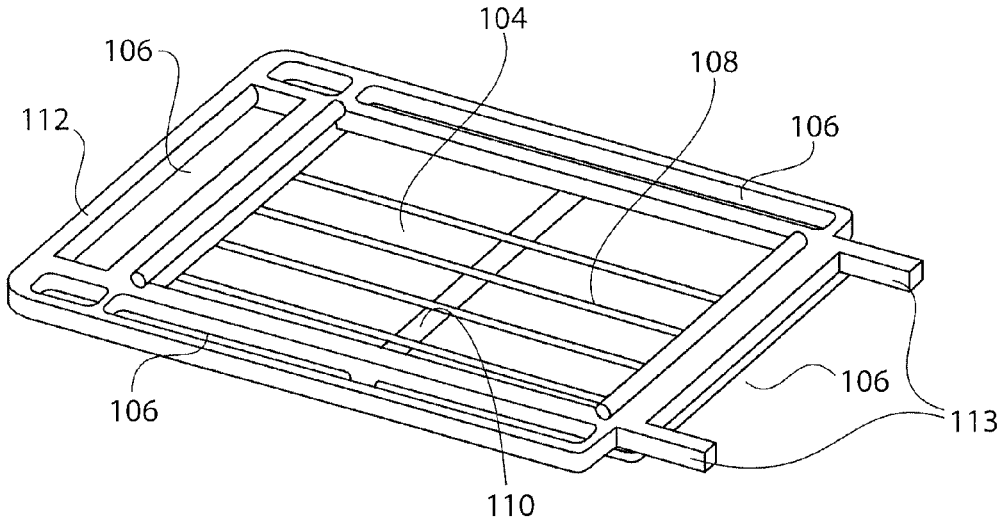
FIGS. 12A and 12B are perspective views of the corona frame according to an implementation of the present principles.
Figure 12B:
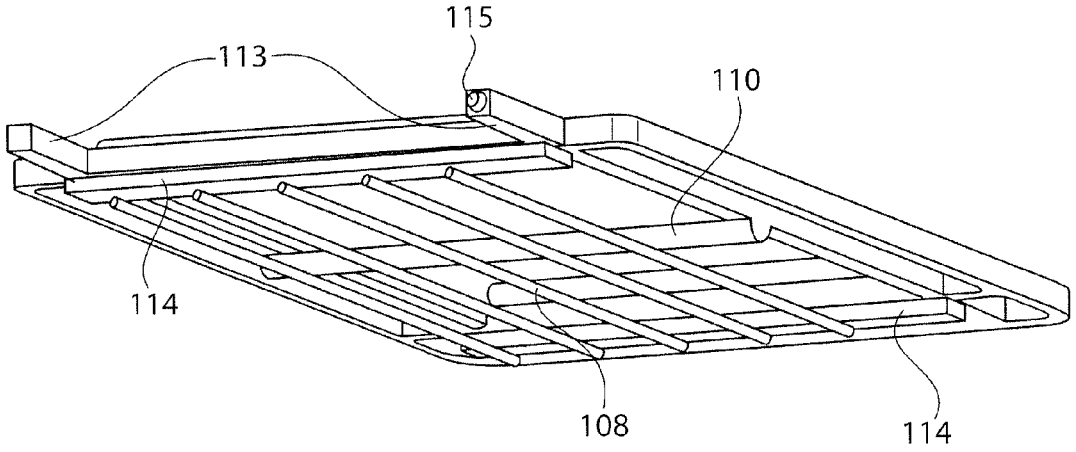

FIGS. 11 and 12 show the preferred implementation of corona wire frame 100 discussed above, from different perspective angles. As mentioned, the passive areas 106 maintain the corona electrodes (wires) 108 at a certain distance from the housing walls. The walls may accumulate some electrically conductive and chemically active matter. If the corona wires 108 are close to the walls, it may cause the so called "creeping" discharge along those walls between the corona electrodes 108 and the oppositely charged collecting electrodes (not shown). The passive or inactive areas 106 extend this creeping path's length and make creeping discharge less likely to occur.

In accordance with the preferred implementation described above, the replaceable parts/supports 114 are the parts to which the corona wires are attached. When the corona wire should be replaced, only these replaceable supports with the attached corona wires are removed and disposed of. A new pair of replaceable supports 114 with new corona wires 108 attached thereto then replaces the removed assembly. The replaceable supports 114 can be made of environmentally friendly and inexpensive materials, like, for example, cardboard.

With the above implementation, the present invention provides several advantages over the known art: 1) when wire replacement is necessary, only the wires and the cheap replaceable supports are disposed of, thus maintaining the other more expensive parts of the corona frame intact; 2) wire replacement is now easy and even enjoyable; and 3) the corona frame can be made as strong as necessary, and could even use more costly material to increase performance, since the frame is no longer disposable.

Generally speaking, a spare wire with two supports is located (and supplied as a spare part) at a separate fixture. This Fixture may hold several sets of wires with the wire replaceable supports.

Figure 13:
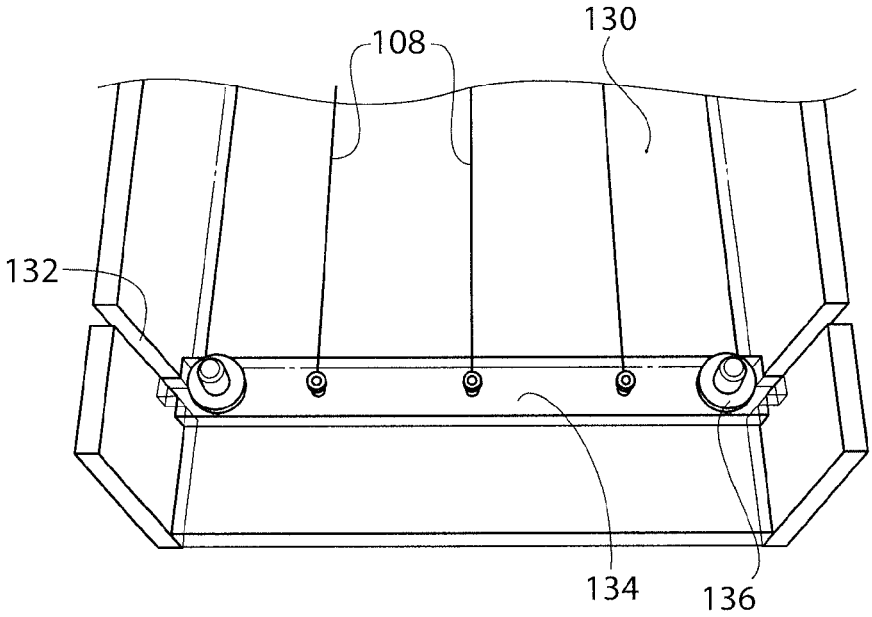
FIG. 13 is a partial perspective view of a corona wire replacement fixture according to an implementation of the present principles.
Figure 14:
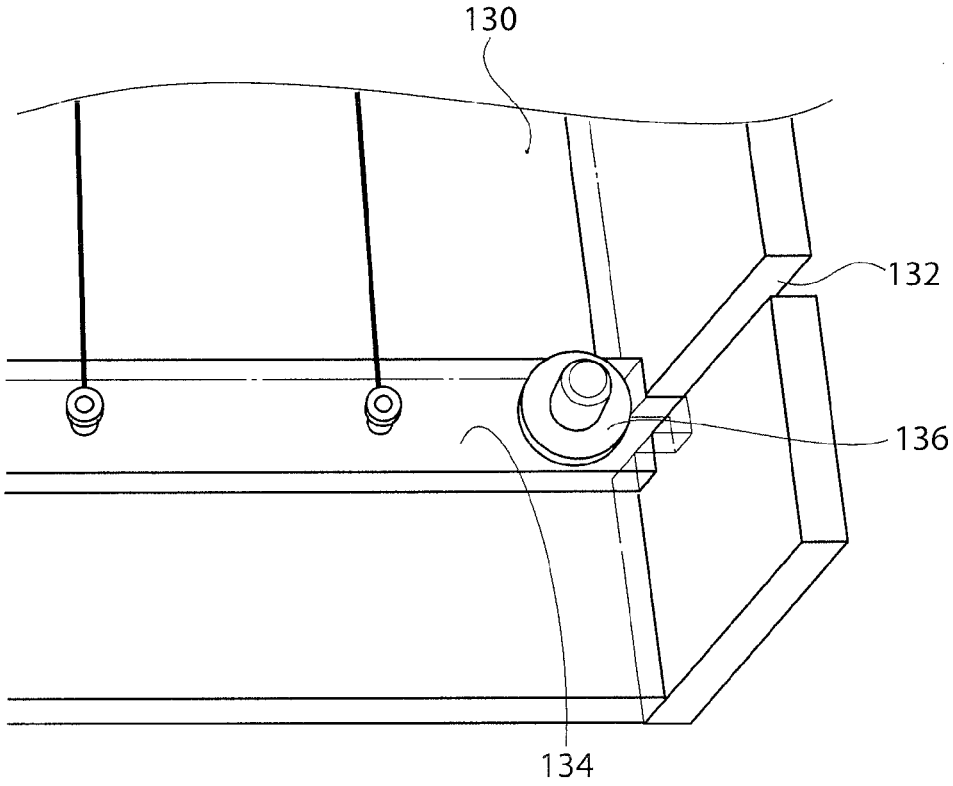
FIG. 14 is an enlarged view of a portion of the corona wire replacement fixture shown in FIG. 13.

FIGS. 13 and 14 show an example of a replacement fixture 130. Referring to FIG. 13, the wires 108 are shown with one support 134 still located within the fixture 130 (waiting to be attached to the corona electrode). The wires 108 with light and cheap replaceable supports 134 are the only parts that are replaced periodically. The replaceable supports 134 do not need to be mechanically strong since they are not designed to keep wires tight and parallel. This is done by the fixture 130 when wires 108 are being placed into the support 134 (as a part of manufacturing process). This is further done by the permanent corona frame (not shown here) when wires are in the device (i.e., transferred from the fixture to the corona frame).

In the FIGS. 13 and 14 a special fixture 130 is partially shown. This fixture 130 is actually the storage unit where several sets of the wires 108 with corresponding supports 134 on the wires ends are secured. The supports 134 are located in the slots 132 where several of them can be stacked on the top of each other. As mentioned above, the supports 134 can be made of cheap and environmentally friendly material, such as, for example, cardboard or steel.

Two replaceable supports 134 are separated from each other by the corona wire length. The supports 134 with the attached wires 108 are packed to the fixture 130 at the manufacturing facility where the wires 108 are attached to the replaceable supports 134 being in the fixture.

Each support 134 has a provision (clip, plug) 136 for the attachment to the permanent corona frame. When the permanent frame engages the replaceable supports 134 that provision 136 holds (secures) the supports 134 on the frame. As an example of such provision a clip (plug) 136 is shown in the FIGS. 13 and 14.

Figure 15:
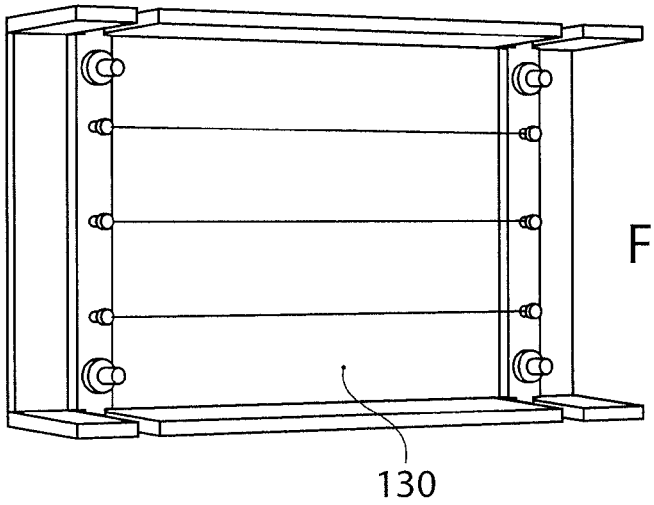
FIG. 15 is another view of the corona wire replacement fixture according to an implementation of the present principles'

The whole fixture 130 with one set of the replaceable supports and wires is shown in the FIG. 15. It should be understood that several more sets (supports with clips and wires) may be placed on the top of each other at the same fixture.

Figure 16:
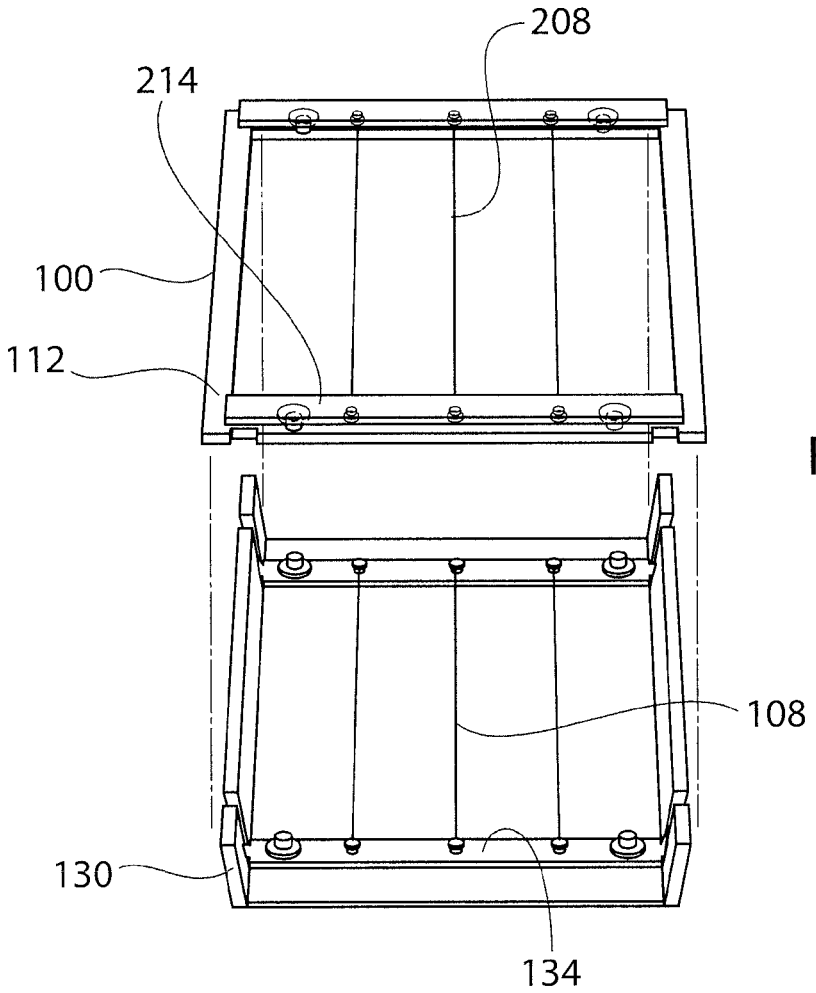
FIG. 16 is a schematic view of the corona wire replacement fixture showing the replacement of corona wires according to an implementation of the present principles.
Figure 17:
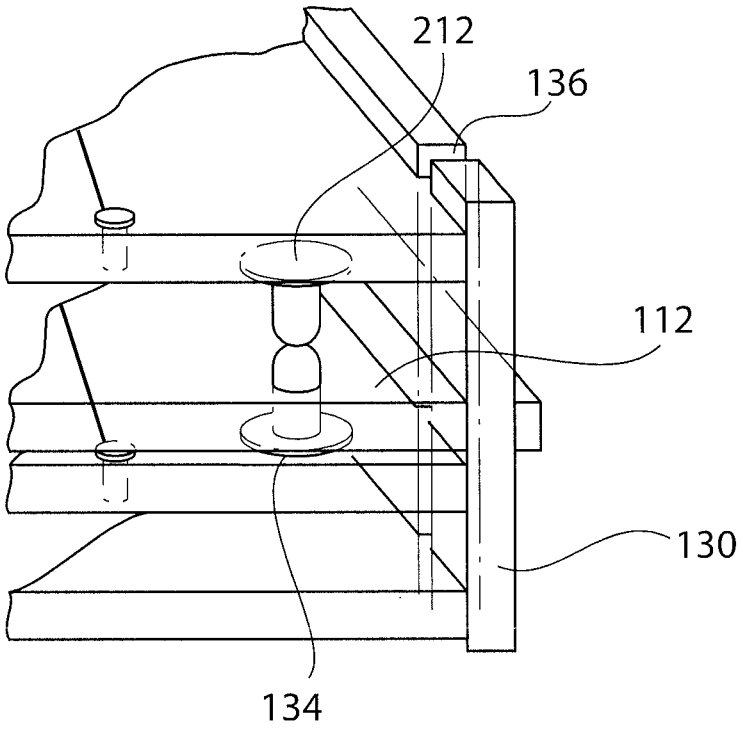
FIG. 17 is an enlarged view of a portion of the corona wire replacement fixture showing the positioning of old and new supports, according to an implementation of the present principles.

In the FIGS. 16 and 17 the proposed corona wire replacement method and procedure are shown. The corona electrode with the old wire 208 (worn out, or broken, or contaminated)) and old replaceable supports 134 are being placed on the top of the fixture 130 and go farther down being directed by the slots 136.

The frame 214 reaches the new replaceable supports 134 and is pressed down against the new replaceable supports. The clips/supports 134 on the new replaceable support 134 push up against the clips/supports of the old replaceable supports 214 and displace them out of the permanent part 112. New replaceable supports 134 attach themselves to the permanent part 112 by four clips 136 (FIG. 14) from the below, i.e., on the opposite side of the frame.

In this manner, the new wires 108 are applied to the corona frame, and the old wires 208 are released and new wires are attached with the single step.

The corona frame design allows it to be symmetrically placed into the air purifier cabinet by rotating by 180°.

FIGS. 18-30 will now describe the collecting cartridge and corresponding collecting electrodes according to a preferred implementation of the present principles. The collecting cartridge with collecting electrodes within an electrostatic air conditioning system is also sometimes referred to as an ion collecting member.

According to one novel aspect of the present principles, the collecting electrodes are made up of a combination of flat thin plate-like collecting electrodes and "bulged" repelling electrodes. The flat and thin collecting electrodes feature becomes available due to the increased distance between the closely spaced collecting electrodes and the corona electrodes/wires located far from them, as shown in the FIG. 18 *b*), i.e., D2>3*D1. With this provision the collecting electrodes create more uniform electric field around their edges and do not produce back corona even being comparatively thin.

Figure 18:
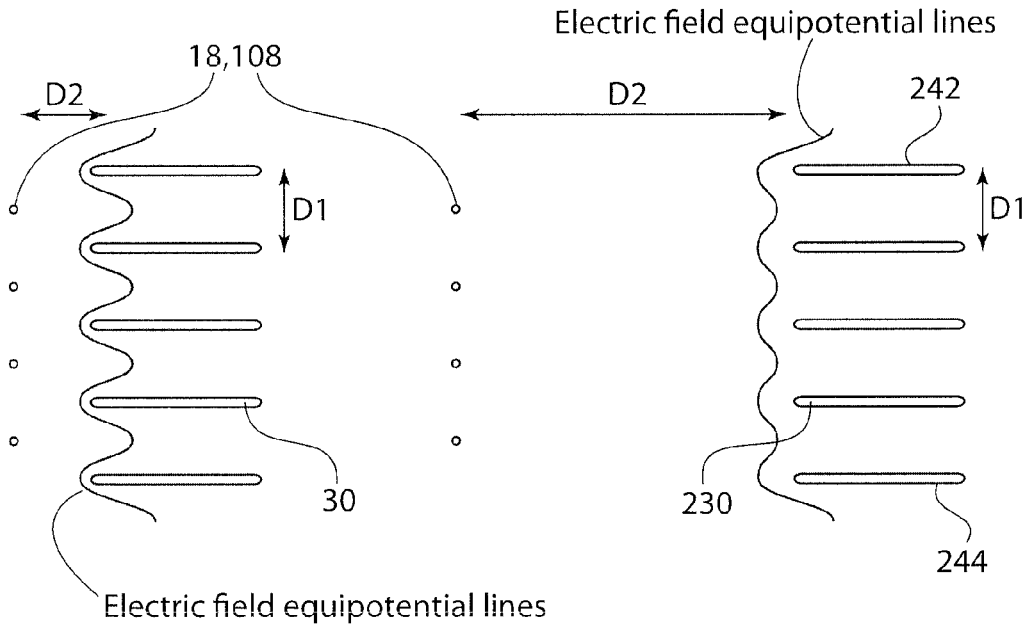
FIG. 18*a* is a schematic view of the positioning of the corona wires with respect to the collecting electrodes according to the prior art.
FIG. 18*b* is a schematic view of the positioning of the corona wires with respect to the collecting electrodes according to an implementation of the present principles.

In FIG. 18, on the left side, a) the corona wires 108 are close to the collecting electrodes 30 (as known from prior art) and the electric filed around the collecting electrodes edges is much stronger, i.e., the equipotential lines are closer to the electrodes, that in the FIG. 18 on the right side b) which is the configuration of the present invention. In accordance with the present invention, the two outermost collecting electrodes 242, 244 are comparatively thick (e.g., >20 times the corona wire diameters) as shown in the FIG. 20.

In the configuration shown in the FIG. 18 *b*) the electric field is still strong near the edges of two outmost collecting electrodes 242, 244. In order to prevent electrical discharge at these places, the two outermost collecting electrodes 242, 244 should be made thicker than the rest of the collecting electrodes 240 as shown in the FIG. 20. Other features of the collecting electrodes include:

1. Two outermost electrodes 242, 244 are thick and therefore strong enough to become a part of the collecting cartridge frame (i.e., the parts of the cartridge that are vertical, and parallel to the corona wires);
2. Two electrically conductive bars (having the smooth shape all around) are placed at the edges of the collecting electrodes (orthogonal to the collecting electrodes) and electrically connected to the collecting electrodes directly or via the resistor. (See element 50 in FIG. 8*b*, and element 234 in FIG. 19. The electrical conductive bars, along with the increased thickness of the two outermost collecting electrodes, enable the conductive bars to "smooth" the electric field along the perimeter.
3. The electrodes are "suspended" in the middle of the housing at the distance K from the walls, where K≥D/2 as shown in the FIG. 7. (D is the distance between the corona frame and the collecting cartridge).

Those of skill in the art will appreciate that the design set forth by the present principles provides several advantage over known designs. For example, there is less air resistance due to the thin and "flat" collecting electrodes, therefore greater CFM and CADR produced by the air conditioner. In addition, the present design not only provides better collecting efficiency (i.e., the collecting electrodes bulges do not push air away from their surfaces as in the prior art), it requires less material for the collecting electrodes (i.e., no heavy bulges) which translates into lower manufacturing cost.

Figure 19A:
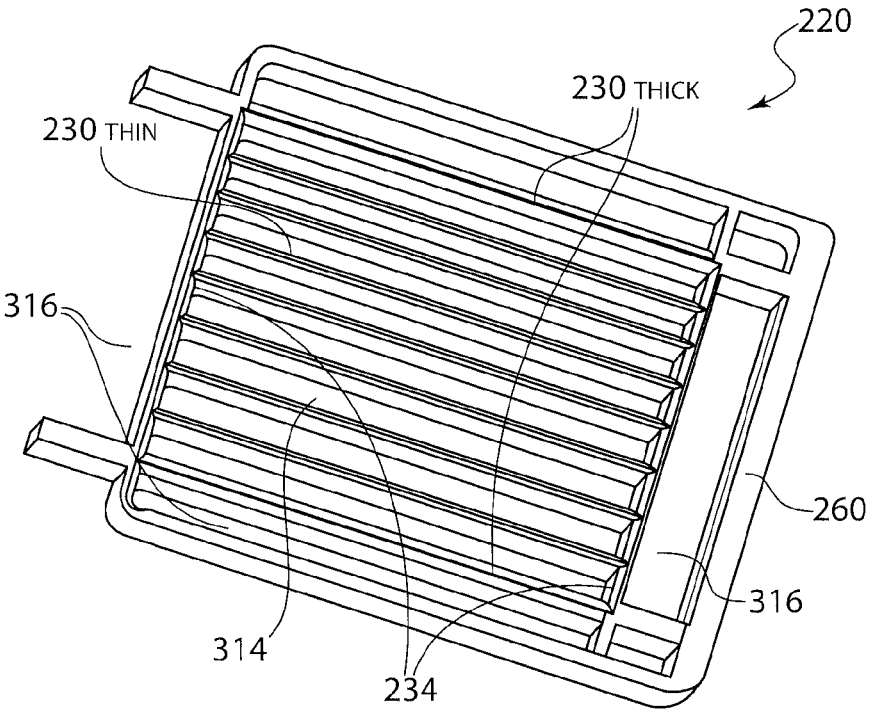
FIG. 19A is a perspective view of the collecting cartridge according to an implementation of the present principles.
Figure 19B:
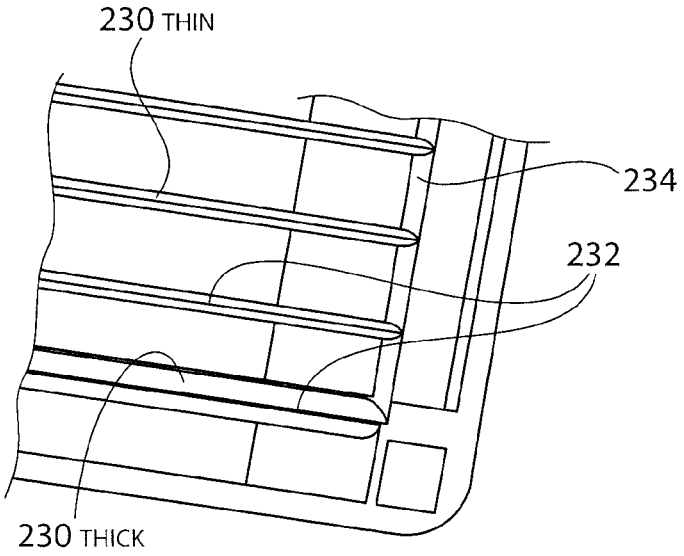
FIG. 19B is an enlarged view of a portion of the collecting cartridge according to an implementation of the present principles.
Figure 20:
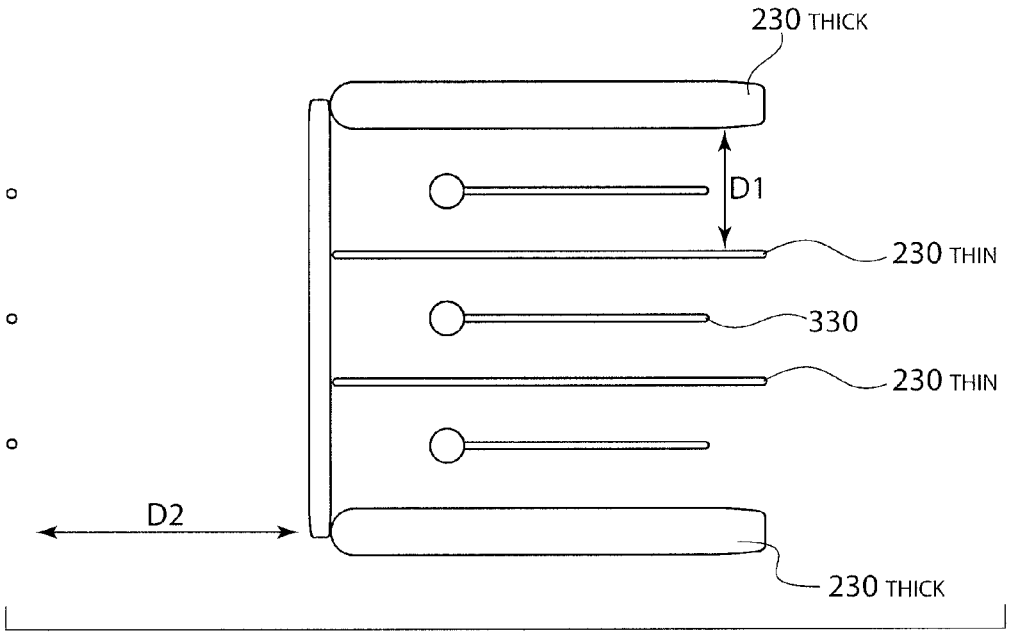
FIG. 20 is a schematic view of a cross section of the electrodes of the collecting cartridge according to a preferred implementation of the present principles.

Referring to FIGS. 19A and 19B, there is shown a new collecting cartridge 220 according to the present principles. Similar to the corona frame, the collecting cartridge is divided into two parts: active areas 314 and passive (inactive) areas 316. The active area 314 is occupied by the collecting electrodes 230 and repelling electrodes 330 (See FIG. 20). All particle collection (i.e., air purification) occurs in the active area 314.

The passive area 316 is at the periphery of the collecting cartridge 220 and generally contains no electrodes. The only conductive part within the passive area is the HV contact hidden in the leg, and a wire that connects the HV contact to the electrode. As is understood, the HV contact and the wire do not perform any air cleaning work.

The passive area 316 may be made air penetrable or non-penetrable. In the first case, the frame supporting ion emitting or ion collecting member can have an opening allowing air to flow between the active area 314 and the sides of the housing. In the second case the passive area 316 blocks air passage and is made from a non-conductive material, such as, for example plastic.

Figure 21:
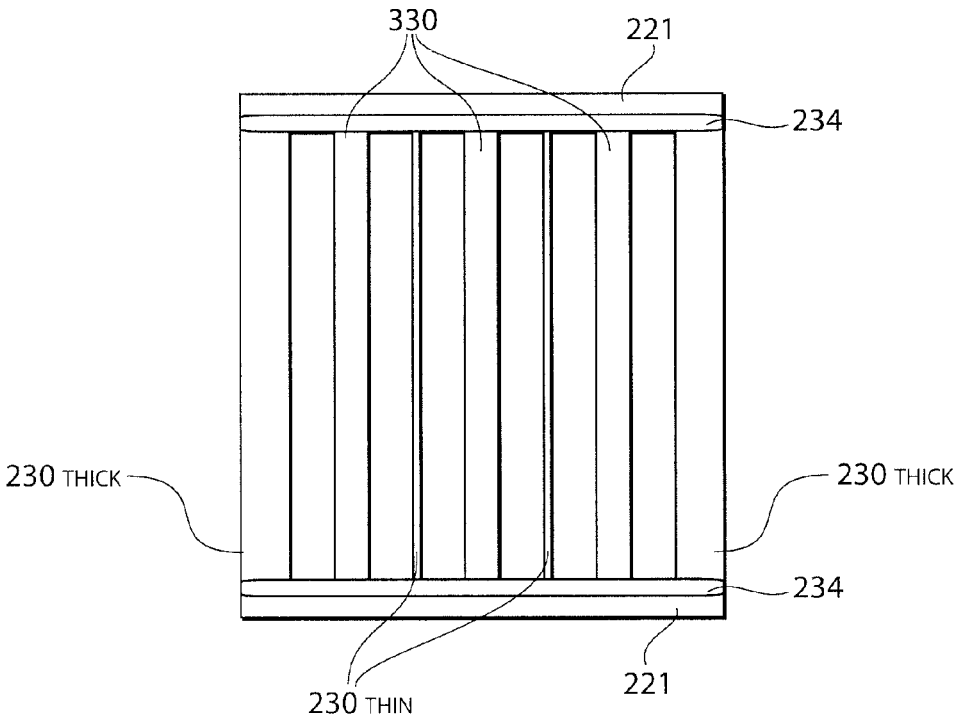
FIG. 21 is another schematic view of the electrodes of the collecting cartridge according to a preferred implementation of the present principles.

FIG. 21 shows a front view (from the air inlet, i.e., corona wires side) of the collecting cartridge 220 according to an implementation of the present principles. Here the outermost collecting electrodes 230 thick are more clearly shown, while the thinner collecting electrodes 230 thin are disposed in between.

Figure 22:
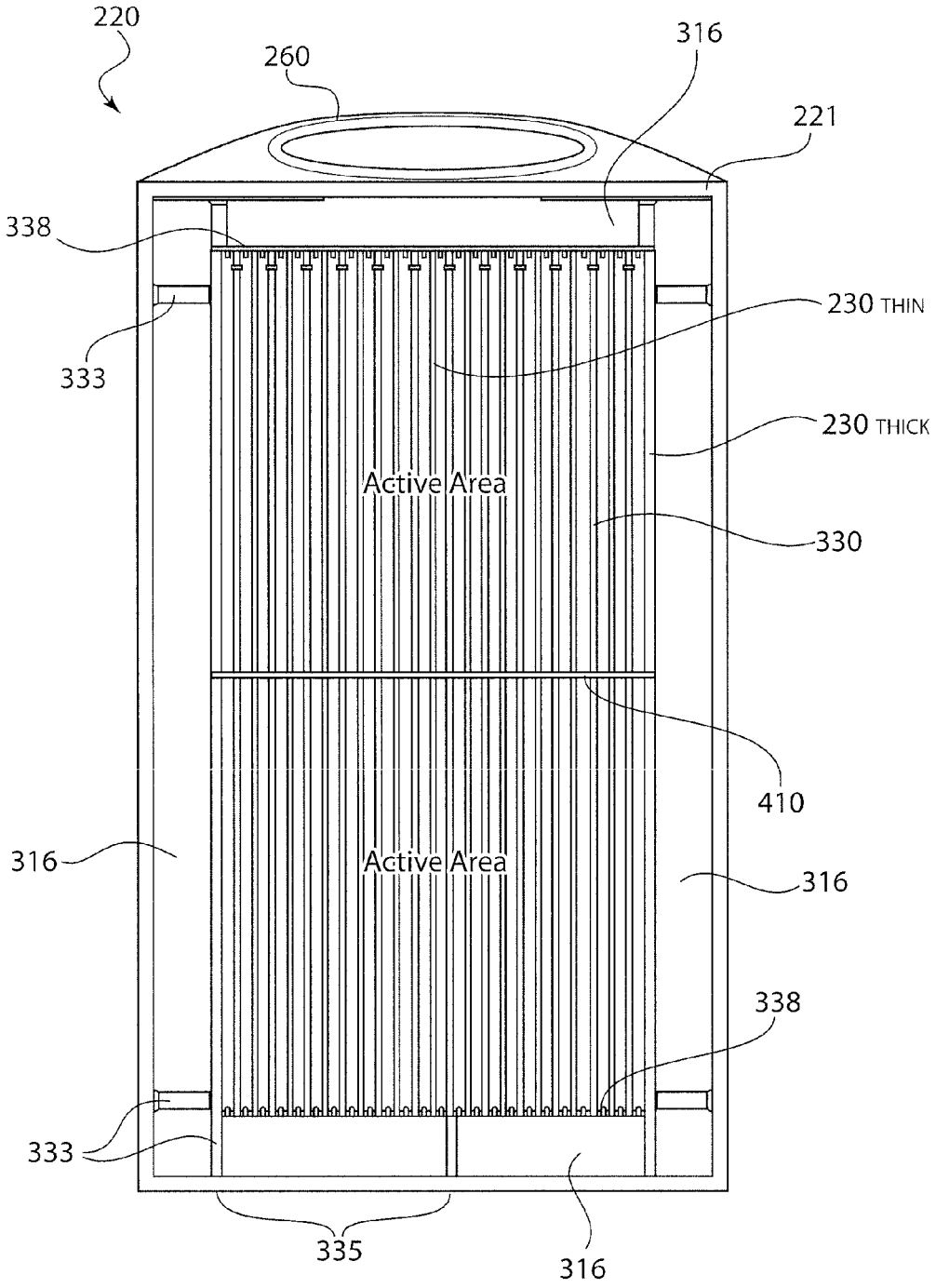
FIG. 22 is a plan view of the collecting cartridge according to a preferred implementation of the present principles.

FIG. 22 shows a back view of the collecting cartridge 220 according to this implementation. The handle 260, the plastic frame 221, the legs 333, the electrical contacts 335, the separators 338 are shown here along with the active area and passive area 316. In this view, one can see the addition of the middle support 410 to the collecting cartridge 220.

Figure 23:
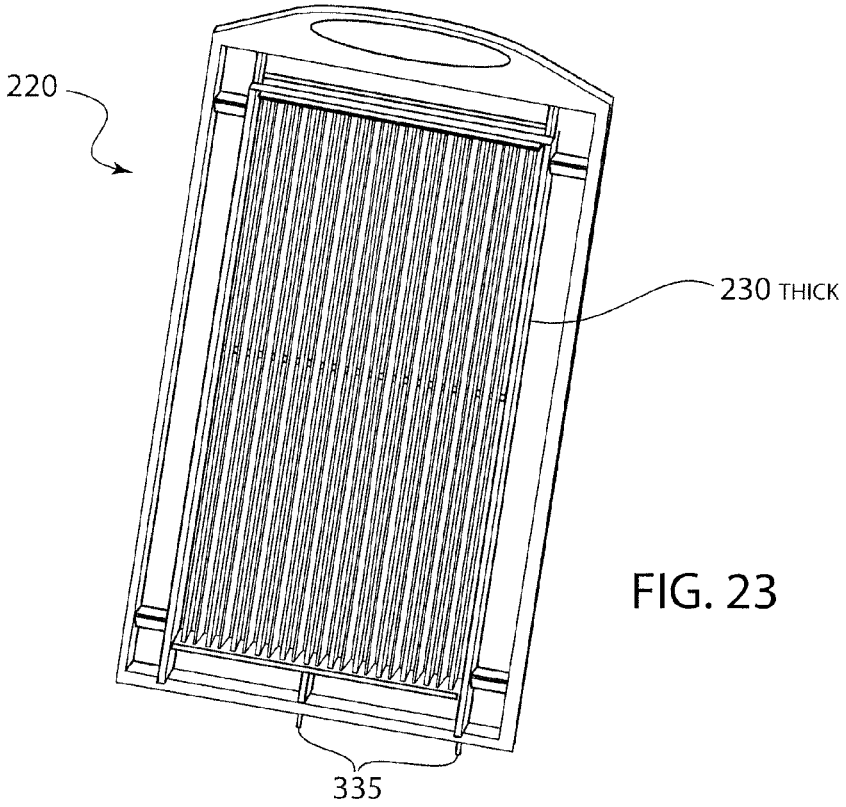
FIG. 23 is a perspective view of the collecting cartridge according to an implementation of the present principles.

FIG. 23 shows a front view (from the corona electrode's side) of the collecting cartridge 220 according to an implementation of the present principles.

Figure 24:
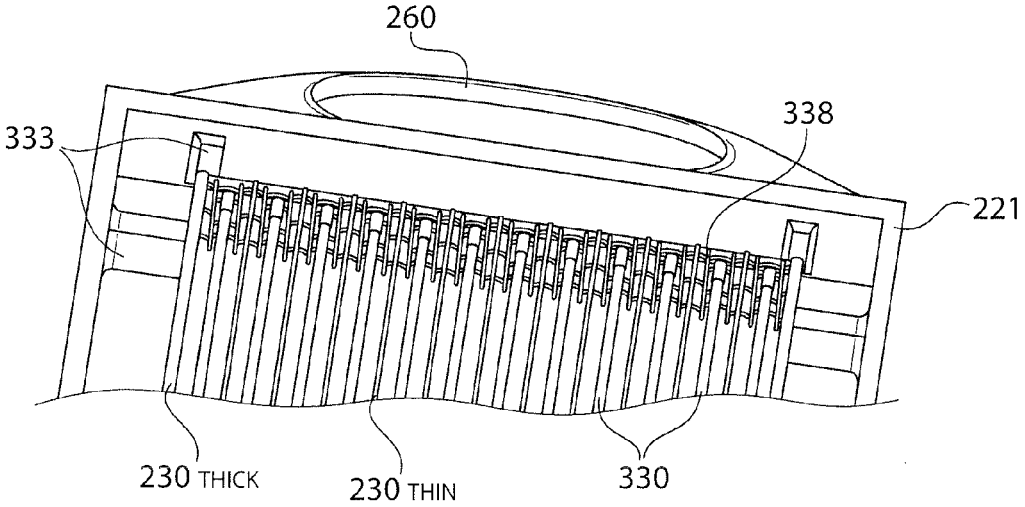
FIG. 24 is a partial perspective view of the collecting cartridge according to an implementation of the present principles.

FIG. 24 shows a partial close up view of the collecting cartridge 220 of FIG. 23. Here, the separator 338 can be seen. The separator 338 functions to keep separate the collecting electrodes 230 and the repelling electrodes 330. In a preferred implementation, the frame 221 of the collector cartridge 220 contains two separators 338, one on the top, another on the bottom, where the collecting and repelling electrodes ends are secured.

Figure 25:
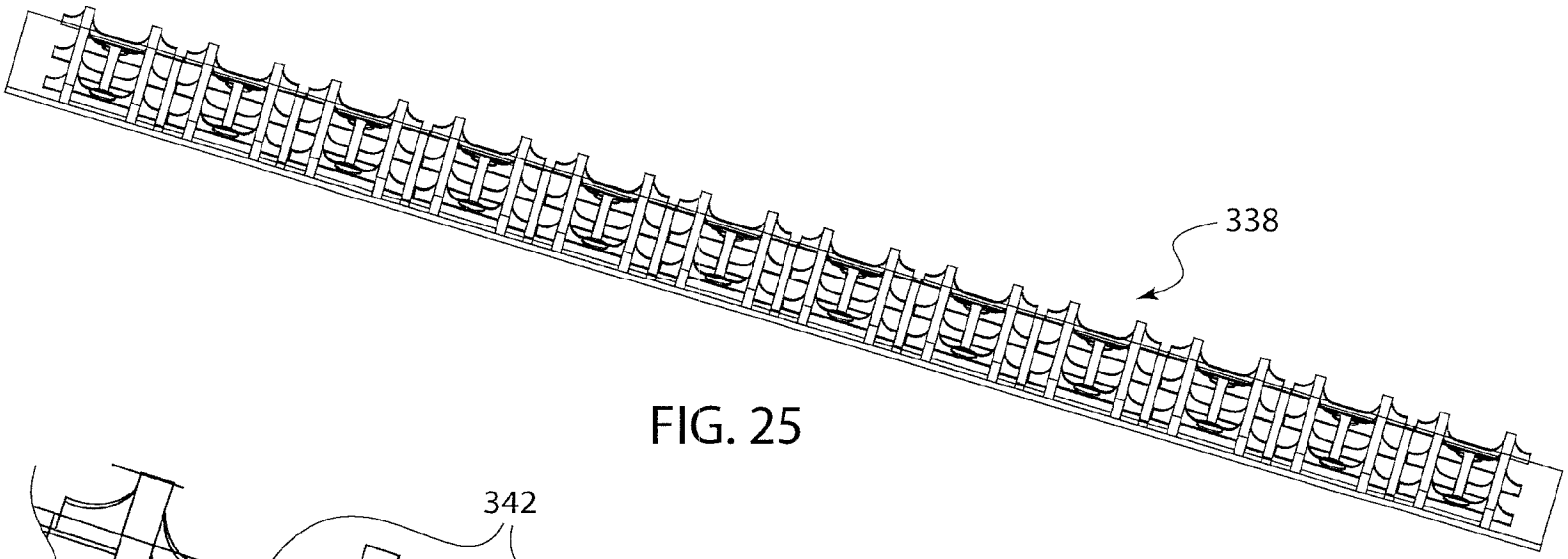
FIG. 25 is perspective view of the electrode separator as implemented in the collecting cartridge, according to an implementation of the present principles.
Figure 26:
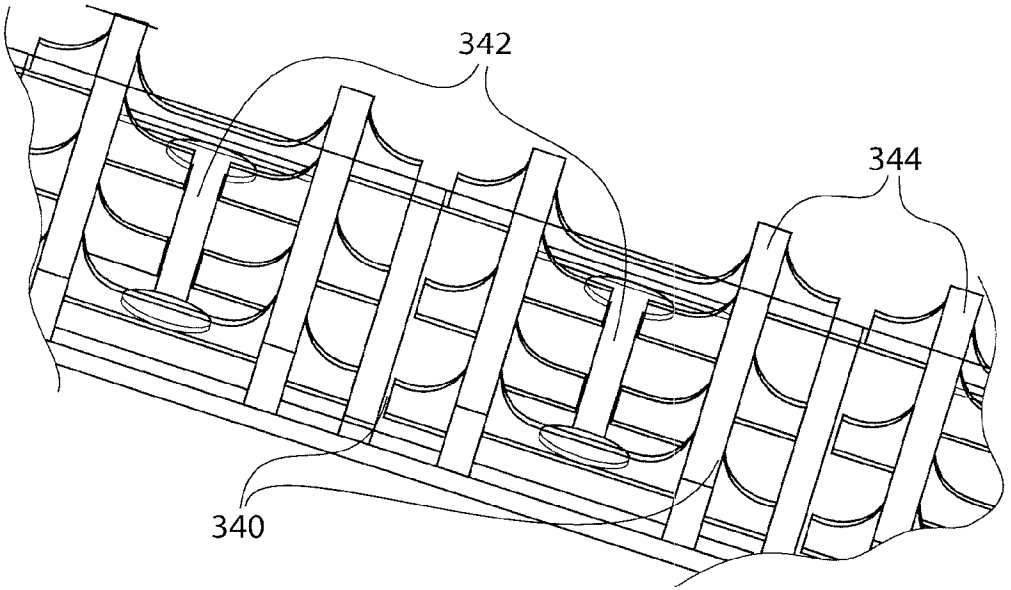
FIG. 26 is an enlarged view of a portion of the electrode separator of FIG. 25, according to an implementation of the present principles.

As shown in FIGS. 25 and 26, the each separator 338 includes a plurality of nests 342 for receiving and securing the repelling electrodes 330, and separate receiving section 340 for receiving and securing each of the collecting electrodes 230. A barrier 344 is positioned between each nest 342 and receiving section 340.

Each separator 338 is made of non-conductive material such as plastic. Alternatively it may be made of antistatic material, i.e., the material with low electrical conductivity. On the other side of the bottom separators the contact strips 360 are located (See FIG. 29). These strips 360 connect the repelling electrodes to each other and to the HV contact on the bottom. The strip on the top connects all collecting plate-like electrodes to each other and to another HV contact via outmost collecting electrode.

Figure 27:
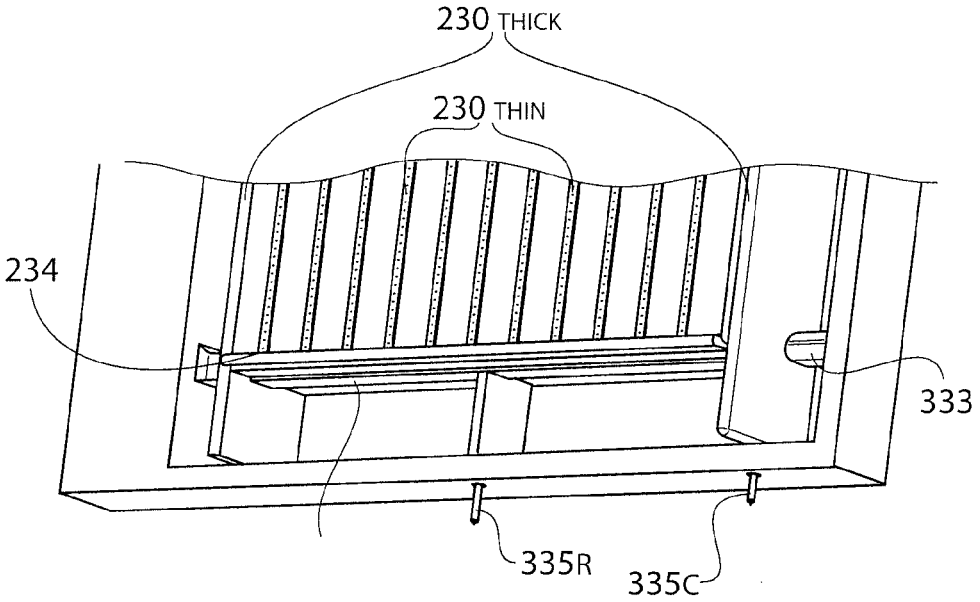
FIG. 27 is a partial perspective view of the collecting cartridge, according to an implementation of the present principles.

FIG. 27 shows an partial view of the collecting cartridge where the HV contacts are separated into an HV contact 335R for the repelling electrodes, and an HV contact 335*c* for the collecting electrodes.

Figure 28:
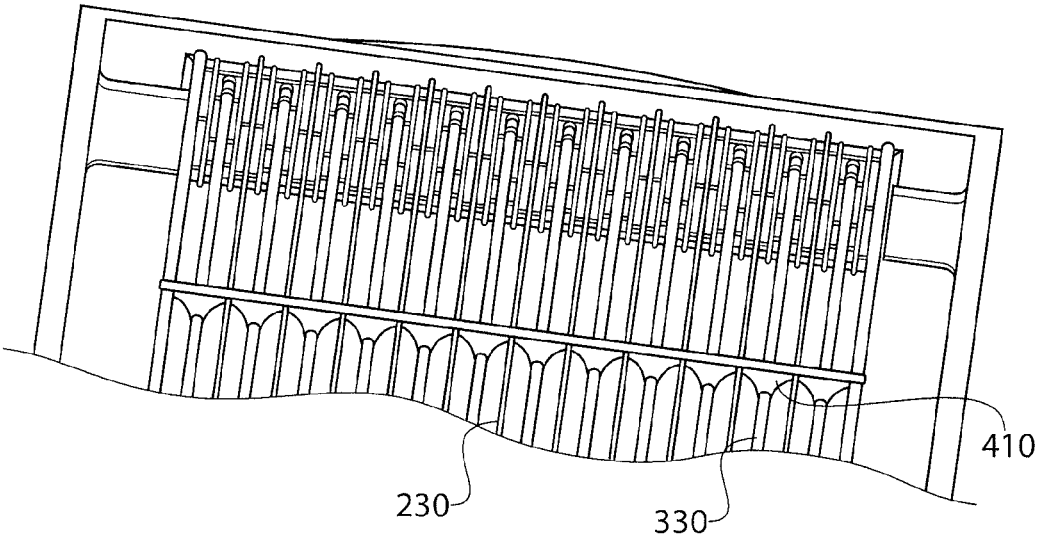
FIG. 28 is partial perspective view of the collecting cartridge showing the middle support, according to an implementation of the present principles.
Figure 29:
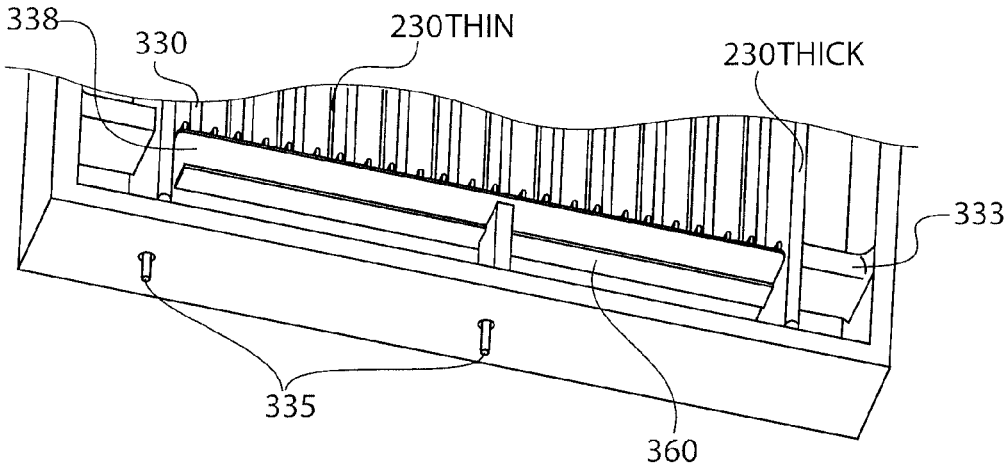
FIG. 29 is partial bottom perspective view of the collecting cartridge showing the bottom positioned separator, according to an implementation of the present principles.
Figure 30:
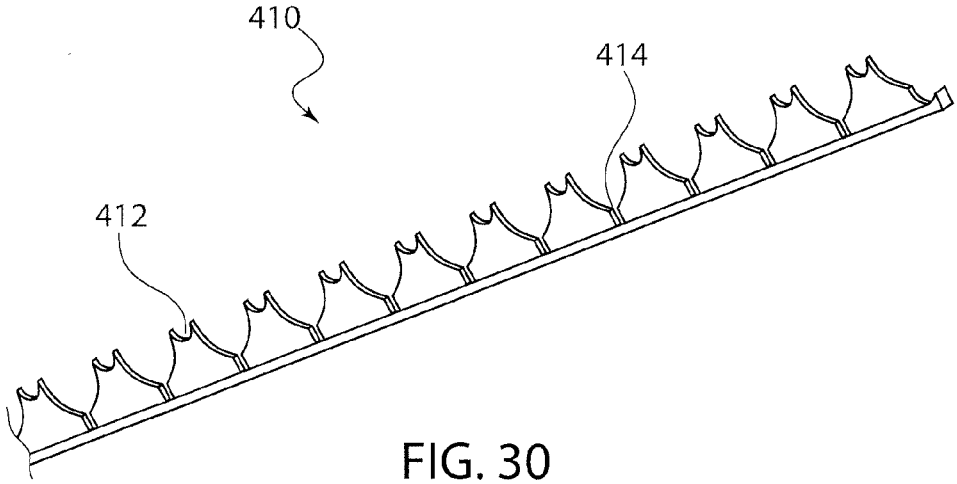
FIG. 30 is a perspective view of the middle support of the collecting cartridge, according to an implementation of the present principles.

FIGS. 28 and 30 shows an example of a middle support 410 as positioned in the collecting cartridge and between the repelling 330 and collecting electrodes 230. Middle support 410 is preferably made of antistatic material that has limited electrical conductivity. The support 410 includes areas 412 for supporting the repelling electrodes and an area 414 for supporting the collecting electrodes. Support 410 serves to keep the collecting and repelling electrodes at the distance from each other and also to discharge stray capacitance between the collecting and repelling electrodes. In previous electrostatic filters implementations, this stray capacitance held a large amount of electrical energy. This energy was then often released into the hands of the person who removed the collecting cartridge from the device and touches both electrodes (i.e., collecting and repelling).

Antistatic support 410 has low electrical conductivity that does not present substantial electrical load, i.e., current through the middle support is very low. However, this current is great enough to discharge stray capacitance in order of seconds. In this case the risk of electrical zapping is greatly diminished.

For an example, the cartridge's stray capacitance C is equal to 500 pF. To discharge it within 5 seconds time constant $\tau$ should be equal to 1 sec. Therefore, middle support resistance R should be equal to $R=\tau/500*10^{-12}=2*10^{9}\Omega$. Presuming the potential difference between the collecting and repelling electrodes equal to 6 kV, power losses P at the middle support are equal to $P=6{,}000^2/2*10^9=0.018$ W. It will be appreciated that this is a negligible amount of dissipated power.

In the claims hereof, any element expressed as a means for performing a specified function is intended to encompass any way of performing that function. The present principles as defined by such claims reside in the fact that the functionalities provided by the various recited means are combined and brought together in the manner which the claims call for. It is thus regarded that any means that can provide those functionalities are equivalent to those shown herein.

Reference in the specification to "one embodiment" or "an embodiment" of the present principles, as well as other variations thereof, means that a particular feature, material, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

These and other features and advantages of the present principles may be readily ascertained by one of ordinary skill in the pertinent art based on the teachings herein. It is to be understood that the teachings of the present principles may be implemented in various forms of hardware, software, firmware, special purpose processors, or combinations thereof.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. An electrostatic air conditioner system comprising:

a housing made of electrically insulating material and having inlet vent, outlet vent, and sides;

an ion emitting member located on and detachable from a corona frame and an ion collecting member located on a separate collector frame, both the corona frame and the collector frame positioned in said housing, said ion emitting member and said ion collecting member being located at a first distance D from each other;

a high voltage generator configured to provide a potential difference at first and second output terminals between said ion emitter and said ion collector members;

said ion emitting member contains thin electrically conductive wires attached to the corona frame;

wherein at least one of the ion emitting member and the ion collecting member comprises an active and a passive area, said active area containing electrically conductive electrodes while said passive area containing non-conductive media;

said active area being located at a second distance f for the ion emitting member, and at a third distance K for the ion collecting member, from the sides of the housing.

2. The system of claim 1, wherein at least one of said ion emitting and ion collecting member is removable from the housing.

3. The system of claim 1, wherein the ion emitting members and ion collecting members are substantially parallel to each other.

4. The system of claim 1, wherein the ion emitting member contains thin wire-like electrically conductive electrodes connected to a first terminal of the high voltage generator.

5. The system of claim 1, wherein the ion collecting member contains flat plate-like elongated collecting electrodes connected to a second terminal of the high voltage generator.

6. The system of claim 1, wherein both the second distance f and third distance K are equal to or greater than a half of the first distance D, i.e., $f \geq D/2$ and $K \geq D/2$.

7. The system of claim 1, further comprising smooth shape conductive members located at ends of the ion emitting members, electrically connected to electrodes of the ion emitting member, and exposed to an area between the ion emitting member and the ion collecting member.

8. The system of claim 1, further comprising smooth shape conductive members located at ends of the ion collecting members and electrically connected to electrodes of the ion collecting member.

9. The system of claim 7, wherein said conductive members are of elongated shape and are substantially orthogonal to the corresponding electrodes they are electrically connected to.

10. The system of claim 8, wherein said conductive members are of elongated shape and are substantially orthogonal to the corresponding electrodes they are electrically connected to.

11. The system of claim 1, wherein in at least one part of said passive area located on one member (ion emitting or ion collecting) is recessed with regards to the corresponding electrode away from the opposite member (ion collecting or ion emitting member respectively).

12. The system of claim 1, wherein ion emitting member comprises:

a frame comprising an electrically insulating material;

a plurality of wire-like ion emitting electrodes connected parallel to each other and supported by the frame; and at least one smooth shape conductive member located at an ends of the plurality of wire-like ion emitting electrodes, said smooth shape conductive member being electrically connected to the wire-like ion emitting electrodes.

13. The system of claim 12, wherein said smooth shape conductive member comprises an elongated shape and is orthogonal to the wire-like emitting electrodes.

14. The system of claim 12, wherein said ion emitting member comprises active and passive areas, said active areas containing the wire-like ion emitting electrodes, said passive areas containing non-conductive media, and wherein said active area is positioned at a second distance f from the housing sides, said second distance f being no less than ½ of the first distance D.

15. The system of claim 14, wherein the ion emitting member further comprises: permanent and replaceable parts, wherein at least one of said replaceable parts comprises corona wires and supports, where the corona wires are attached to the supports; and the supports are attached to a permanent part of the ion emitting member.

16. The system of claim 12, wherein the ion emitting member further comprises a supporting member located in the active area at the opposite side from the ion collecting member and being in mechanical contact with at least one corona wire.

17. The system of claim 12, wherein said smooth conductive member is propagated along a perimeter of the active area.

18. The system of claim 16, wherein said supporting member is configured for easy detachment from and attachment to a permanent part.

19. The system of claim 1, wherein the ion collecting member comprises:

an inner active area and periphery passive areas, said active area containing the collecting electrodes while said passive areas contain non-conductive media, wherein said active area is located at the third distance K from the housing sides; said distance K is no less than 0.5 of first distance D.

20. The system of claim 19, wherein the ion collecting member comprises:

collecting electrodes and repelling electrodes located between the collecting electrodes, said repelling electrodes comprising flat parts substantially parallel to air flow and protuberant parts substantially orthogonal to the air flow.

21. The system of claim 20, wherein the ion collecting member further comprises one or more middle non-conductive support members between the collecting and repelling electrodes that are in mechanical contact with both collecting and repelling electrodes and configured to support the collecting electrodes and repelling electrodes mid-way between their respective ends at equal distances from each other.

22. The system of claim 21, wherein middle support members are positioned opposite from an ion emitting member side of the ion collecting member and repelling electrodes.

23. The system of claim 21, wherein the middle support member is made of limited electrical conductivity material.

24. The system of claim 1, further comprising a rod antenna-like electrical discharge detector located in the vicinity of the ion-emitting and/or ion collecting members and being configured to detect an electrical discharge and send an electrical signal to the high voltage generator.

25. The system of claim 24, wherein the high voltage generator reduces the generated the potential difference in response to the electrical signal received from the antenna-like electrical discharge detector.

26. The system of claim 1, wherein the passive area comprises air.

27. The system of claim 1, wherein the passive area comprises a solid non-conductive media.

28. The system of claim 15, wherein said supports comprise a provision for easy detachment from and attachment to the permanent part.

29. The system of claim 15, wherein the corona electrode is symmetrical.

30. The system of claim 15, wherein said replaceable part has a provision for the attachment to the permanent part.

31. The system of claim 20, wherein at least one outermost collecting electrode comprises a thickness equal to two or more times a thickness of inner collecting electrodes.

32. The system of claim 20, further comprising smooth shaped conductive members located at ends of the ion collecting members and electrically connected to electrodes of the ion collecting member.

33. The system of claim 32 wherein said smooth conductive members are propagated along a perimeter of the active area of the ion collecting member.

* * * * *